US006192748B1

(12) United States Patent
Miller

(10) Patent No.: US 6,192,748 B1
(45) Date of Patent: Feb. 27, 2001

(54) DYNAMIC ORIENTING REFERENCE SYSTEM FOR DIRECTIONAL DRILLING

(75) Inventor: Robert G. Miller, Calgary (CA)

(73) Assignee: Computalog Limited, Calgary (CA)

( * ) Notice: Subject to any disclaimer, the term of this patent is extended or adjusted under 35 U.S.C. 154(b) by 0 days.

(21) Appl. No.: 09/183,500

(22) Filed: Oct. 30, 1998

(51) Int. Cl.[7] ..... E21B 7/06; E21B 43/119; E21B 29/06

(52) U.S. Cl. ..... 73/152.01; 73/152.43; 73/152.46; 175/45; 175/80; 166/117.6; 166/255.3

(58) Field of Search ..... 73/152.01, 152.43, 73/152.46, 152.54, 152.57; 166/255.2, 255.3, 66.5, 117.5; 175/45, 61, 79, 80, 81–83; 33/304, 333

(56) References Cited

U.S. PATENT DOCUMENTS

| | | | | |
|---|---|---|---|---|
| 2,438,293 | | 3/1948 | Livingston | 116/66 |
| 4,307,780 | | 12/1981 | Curington | 116/113 |
| 4,438,810 | * | 3/1984 | Wilkinson | 166/65 |
| 5,394,950 | * | 3/1995 | Gardes | 175/45 |
| 5,467,832 | * | 11/1995 | Orban et al. | 175/45 |
| 5,602,541 | * | 2/1997 | Comeau et al. | 175/65 |
| 5,727,629 | * | 3/1998 | Blizzard, Jr. et al. | 166/298 |
| 5,821,414 | * | 10/1998 | Noy et al. | 73/152.54 |
| 5,871,046 | * | 2/1999 | Robison | 166/241.1 |
| 5,947,201 | * | 9/1999 | Ross et al. | 166/298 |

* cited by examiner

*Primary Examiner*—Hezron Williams
*Assistant Examiner*—J. David Wiggins
(74) *Attorney, Agent, or Firm*—Felsman, Bradley, Vaden, Gunter & Dillon, LLP

(57) ABSTRACT

A directional drilling control system allows dynamic orientation of downhole drilling equipment in unstable or corrupt natural magnetic fields without the use of gyroscopic measurement devices. The system is especially suited for sidetracking wells. The system includes a permanent or retrievable whipstock having referencing magnets embedded along the centerline of its face, and a measurement while drilling (MWD) instrument assembly. The instrument assembly contains at least one sensor which can accurately determine orientation of the mud motor relative to the reference magnets. The relative positioning of the mud motor is transmitted to the surface by way of a steering tool or MWD telemetry system. The direction of the mud motor or tool face is adjusted by turning the drill pipe at the surface. As drilling progresses, shifts in the orientation of the mud motor due to reactive torque at the drill bit will be indicated in real time so that adjustments may be made at the surface as required.

21 Claims, 2 Drawing Sheets

DYNAMIC ORIENTING REFERENCE SYSTEM FOR DIRECTIONAL DRILLING

TECHNICAL FIELD

This invention relates in general to measurement while drilling tools and in particular to a directional drilling control system for steering a well in the vicinity of well casing.

BACKGROUND ART

Oil and gas wells normally employ steel casing as a conduit for produced or injected substances. In recent years, many operators have begun to re-enter and sidetrack existing wells to take advantage of newer technologies such as horizontal and underbalanced drilling techniques. The existing practice requires that a gyroscopic directional survey of the cased well be conducted to establish an accurate profile of the well and a starting point for the sidetrack. Steel casing disrupts the earth's natural magnetic field and precludes the use of directional measurement devices which depend on the earth's magnetic field as a reference. State of the art gyro systems employ costly earth rate gyroscopes and surface readout features which dictate the requirement for electric conductor wireline equipment as well.

Once the well has been surveyed, a bridge plug and a casing whipstock are located at the sidetrack point and oriented in the desired direction of deviation. If the well is vertical or near vertical, the whipstock is oriented using the gyro surveying equipment. A series of milling tools are used to machine a slot in the casing and thereby create an exit point or window. A drill bit driven by a downhole mud motor equipped with a bent housing member is employed to deviate the new wellbore in the desired direction.

In vertical or near vertical wells, a gyroscopic orienting instrument is once again required to orient the motor toolface in the same direction the whipstock was aligned. Since gyroscopic instruments are not built to withstand the shock forces encountered while drilling, the gyro is pulled up into the drill pipe before drilling commences. As drilling progresses, operations must be halted periodically to check the motor's toolface orientation with the gyro. Moreover, these checks are done in a static condition which does not give an accurate indication of reactive torque at the bit and therefore requires the operator to extrapolate the actual toolface orientation while drilling. Drilling must continue in this manner until enough horizontal displacement has been achieved in the new wellbore to escape the magnetic effects of the steel casing on a magnetically referenced orienting device such as a wireline steering or a measurement while drilling (MWD) tool. Alternatively, drilling must continue until enough angle has been built to allow the use of a steering tool or MWD-based gravity referenced orienting device. Only at this point can the gyro and wireline equipment be released and the more cost effective and operationally superior MWD tool be employed.

This conventional method of steering a sidetracked well in the vicinity of steel casing has two disadvantages. First, the requirements for gyroscopic survey equipment and electric conductor wireline equipment add significant cost to the operation. During the time that milling operations are in progress, this equipment is normally kept on standby. Once drilling begins, the actual operating time of the gyro survey equipment is minimal even though the time to release of its services may be substantial. The gyro service incorporates highly sensitive equipment which commands high service charges and, along with the wireline service, requires two or three operations personnel to operate the equipment.

The second disadvantage of the prior art methods relates to their accuracy. The orientation method is inferior as it normally incorporates static instead of dynamic survey data. In operation, the gyro is seated in the muleshoe with the rig's mud pumps turned off. The motor toolface is oriented in this condition and the gyro is pulled up into the drill string before the pumps are started and drilling commences. During drilling, the drill bit's interface with the formation generates reactive torque which causes the orientation of the motor toolface to rotate counterclockwise from its initial setting. Although numerous orientation checks may be made to determine the effects of reactive torque, the gyro equipment cannot be used to obtain orientation data while drilling is in progress. Data obtained must be extrapolated and assumed values used to correct for reactive torque. Since the severity of reactive torque is a function of drill bit torque, drillers normally use low bit weights while orienting with gyro equipment in order to minimize effects on the toolface orientation. This results in slow penetration rates and even higher costs associated with the sidetrack procedure.

DISCLOSURE OF THE INVENTION

A directional drilling control system allows dynamic orientation of downhole drilling equipment in unstable or corrupt natural magnetic fields without the use of gyroscopic measurement devices. The system is especially suited for sidetracking wells. The system includes a permanent or retrievable whipstock having referencing magnets embedded along the centerline of its face, and a measurement while drilling (MWD) instrument assembly. The instrument assembly contains at least one sensor which can accurately determine orientation of the mud motor relative to the reference magnets. The relative positioning of the mud motor is transmitted to the surface by way of any MWD or wireline steering tool telemetry system. The direction of the mud motor or tool face is adjusted by turning the drill pipe at the surface. As drilling progresses, shifts in the orientation of the mud motor due to reactive torque at the drill bit will be indicated in real time so that adjustments may be made at the surface as required.

BEST MODE FOR CARRYING OUT THE INVENTION

Figure 1:
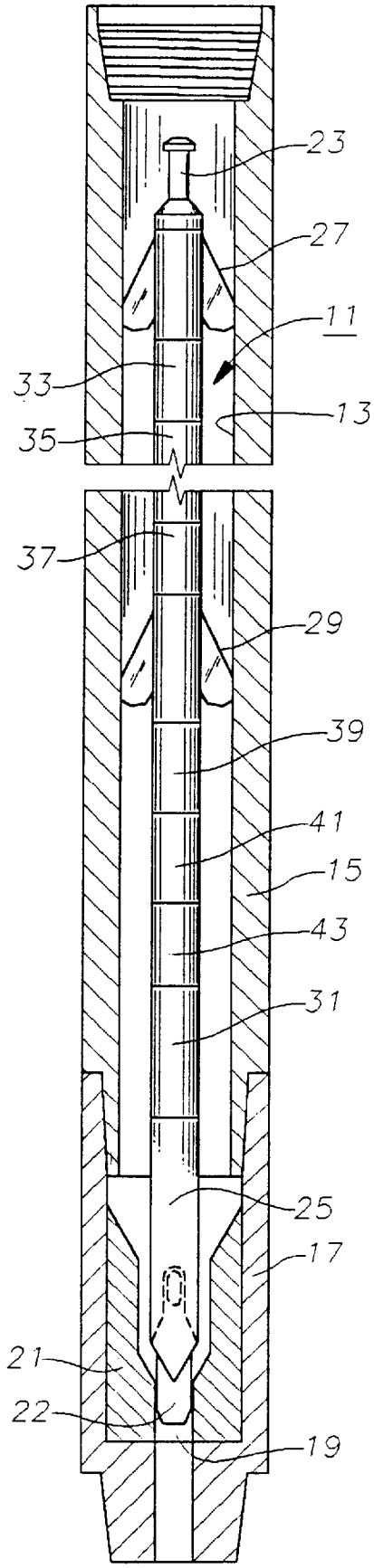
FIG. 1 is a schematic sectional side view of a drilling system in a drill pipe which is constructed in accordance with the invention.

Referring to FIG. 1, a measurement while drilling (MWD) system tool 11 is schematically shown suspended in the bore 13 of a string of non-magnetic drill pipe or collar 15 which includes an orienting sub 17. The lower end of tool 11 is supported in an orientation sleeve 21 of sub 17. Tool 11 has a pulser 25 with a valve member 22 which reciprocates axially within an orifice 19 to alternately restrict and release mud flow through orifice 19. This creates mud pulses which are monitored at the surface. In the preferred embodiment, orientation sleeve 21 is an orienting key and sub 17 is a muleshoe sub. Orientation sleeve 21 will rotate tool 11 in a particular position relative to sub 17 as tool 11 stabs into orientation sleeve 21.

The upper end of tool 11 includes a carrier or flared portion and neck 23 for releasable attachment to wireline. In the preferred embodiment, neck 23 also may have a pin for a J-slot releasing tool or may be run using a hydraulic releasing tool. As an alternate to being conveyed by wireline, tool 11 may also be installed at the surface in a nonretrievable drill collar of drill string 15. Although tool 11 shown in FIG. 1 is retrievable and reseatable, the invention would also apply to non-retrievable MWD tools or wireline steering tools using any telemetry method.

Tool 11 may be essentially subdivided into two sections: a set of instruments on an upper portion and pulser 25 on a lower portion. The instrument section of tool 11 may have an upper centralizer 27 and a lower centralizer 29. Lower centralizer 29 is located near a longitudinal center of tool 11 while upper centralizer 27 is located above it. Centralizers 27, 29 are in contact with bore 13 and are self-adjusting in the case of retrievable tools or fixed in the case of non-retrievable tools.

A series of components are located along the length of the tool. Near the upper end of tool 11, a first magnetic sensor 33, a battery pack 35 for supplying power to tool 11, and second and third magnetic sensors 37, 31 are connected in descending order. In the preferred embodiment, there may be may more sensors, and each sensor 31, 33, 37 is a single axis magnetometer. However, sensors 31, 33, 37 may also comprise multi-axis units or Hall Effect sensors with a more comprehensive shielding process and a sacrifice in resolution values. Sensors 31, 33, 37 incorporate a shielding material which has an extremely high magnetic permeability and are provided for detecting the orientation of magnetic fields in its vicinity. Sensors 31, 33, 37 are shielded from magnetic fields in a nonmagnetic housing in all but 90 degrees of orientation relative to tool 11.

Figure 2:
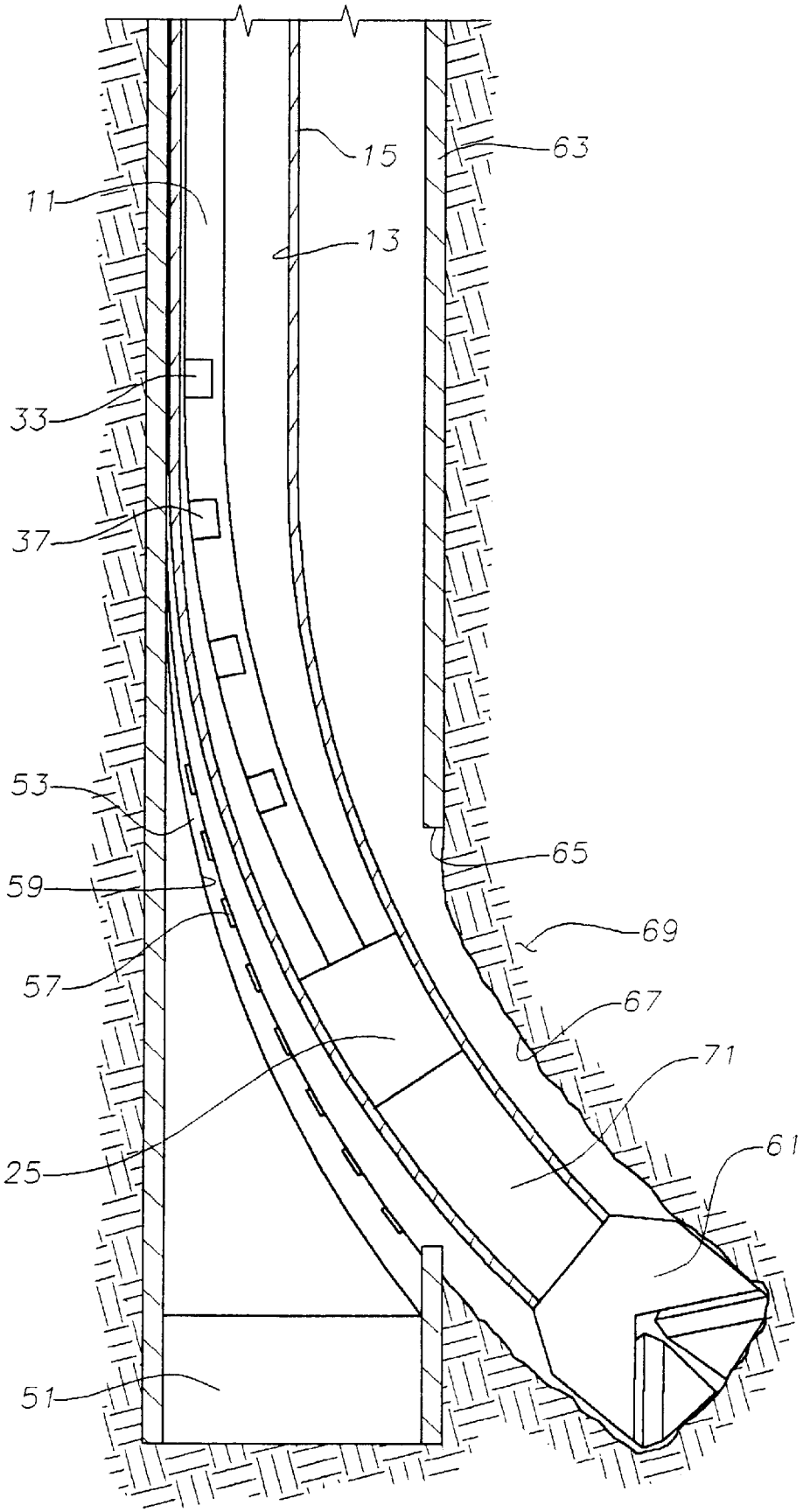
FIG. 2 is an enlarged schematic sectional side view of the drilling system of FIG. 1.

Each sensor 31, 33, 37 has a reference aperture in the shield which is aligned with the vertical axis of tool 11 and oriented 180 degrees away from the orienting key of orientation sleeve 21. Orientation sleeve 21 serves to orient the reference apertures opposite to the toolface of a mud motor 71 (FIG. 2) when tool 11 is seated in the orienting sub 17 (FIG. 1). The shielding material attenuates the exposure of sensors 31, 33, 37 to any magnetic field which is present, except for the area allowed by the reference apertures. Near the lower end of tool 11, a triaxial sensor 39, an instrument microprocessor 41 and a telemetry controller section 43 are connected in descending order. Triaxial sensor 39 is provided for supplying directional and orientation information concerning drilling once outside the influence of steel casing 15 (FIG. 2). Triaxial sensor 39 preferably comprises conventional triaxial magnetometers and accelerometers which are capable of detecting the orientation of tool 11 at 2.5 degrees inclination or greater from vertical. Instrument microprocessor 41 is provided for processing information supplied by tool 11. Telemetry controller section 43 applies signals processed by microprocessor 41 to pulser 25. Valve member 22 of pulser 25 reciprocates axially within orifice 19 to alternately restrict and release mud flow through orifice 19. This creates mud pulses which are monitored at the surface. Alternatively, signals could be sent via wireline or any other MWD telemetry system.

Referring to FIG. 2, a retrievable or permanent whipstock 53 is employed to facilitate milling a window 65 in the casing 63. Whipstock 53 is also used to orient the mud motor 71 and is fitted with referencing magnets 57 which arc axially spaced apart and embedded along the centerline of its face 59. Whipstock 53 is supported on a bridge plug 51 or other locating device in casing 63. The downhole mud motor assembly 71 is mounted to the lower end of sub 17 which is attached to the drill string.

In operation (FIG. 2), a bridge plug 51 is landed in the bore of casing 63 at the sidetrack point. Whipstock 53 is landed on bridge plug 51 and oriented in the desired direction of deviation using gyro surveying equipment (not shown). Once this initial orientation has been completed, the gyro surveying equipment and wireline unit are no longer needed.

A series of milling tools are then used to machine a slot in casing 63 and thereby create an exit point or window 65. After window 65 is created, drill string 15 along with mud motor assembly 71 are run in to begin drilling the new sidetrack wellbore 67 in formation 69. The dynamic-orienting MWD tool 11 is lowered through the drill string 15 on the drilling rig's slick line (not shown) and landed in sub 17. The orientation sleeve 21 will orient tool 11 relative to the tool face of mud motor 71. A hydraulic releasing mechanism (not shown) is used to transport and seat tool 11, minimizing the possibility of premature release.

The operator rotates drill string 15 until sensors 31, 33, 37 are aligned with magnets 57 in whipstock 53. At this point, the toolface of downhole motor 71 will be aligned in the same direction as whipstock 53 (180 degrees from the MWD tool magnetic sensor apertures) and drilling may commence. Mud pulses transmitted through the drilling fluid by pulser 25 are detected at the surface to inform the operator that the sensors 31, 33, 37 are aligned with magnets 57. The drilling fluid circulation causes the mud motor 71 to rotate bit 61. At the same time, the drilling fluid acts as a conduit for pulses generated by the pulser 25 as described above. The drill string 15 will not rotate, although some twist of drill string 15 occurs along its length due to reactive torque of mud motor 71.

As tool 11 enters sidetracked wellbore 67, sensors 31, 33, 37 sense the bearings of their reference apertures relative to magnets 57 in whipstock 53 to determine a relative orientation position of tool 11. Sensors 31, 33, 37 inform the operator of the orientation of the mud motor 71 and bit 61 relative to whipstock 53. This information is transmitted through the fluid in the drill string 15 to the surface. The operator will need to turn drill string 15 some at the surface in response to reactive torque to keep sensors 31, 33, 37 pointing toward magnets 57 and maintain a proper toolface orientation. The use of single axis magnetometers enhances the resolution of sensors 31, 33, 37 and allows both precise orientation and the ability to detect the relative position of magnets 57 when the aperture in sensors 31, 33, 37 is up to 90 degrees out of alignment.

The telemetry controller section 43 is used to drive pulser 25 to transmit raw magnetic parameter data from each sensor 31, 33, 37, as well as measurements from conventional magnetic and gravity sensors like triaxial sensor 39, to the surface interface and computer.

As drilling progresses, the values emitted by sensors 31, 33, 37 are monitored and orientation adjustments for reactive torque are made with no disruption of drilling. Sensors 31, 33, 37 are relied upon for proper orientation until reliable gravity or magnetic reference orientations are obtained. During this period, transmission sequences will include readings from several different sensors 31, 33, 37, unshielded tri-axial magnetometers 39, and accelerometers (not shown). As sensor 31 passes into sidetracked bore 67 and out of range of magnets 57, upper sensors 33 and 37 will continue to provide orientation information to the operator. The quantity of information being transmitted is required to enable the process of quantifying data while still utilizing the dynamic mode of orientation control. Eventually, after about 30 feet into sidetrack borehole 67, sensors 31, 33, 37 will be out of range of magnets 57. Also, the conventional sensors 39 will no longer be influenced by the steel casing 63. The operator may continue drilling and steering with sensors 39.

Alternatively, the operator may retrieve tool 11 with the slick line and replace it with a conventional directional measurement tool or a logging while drilling configuration. Should tool 11 have two-way communication capabilities, an alternative to retrieving and replacing it would be to redefine the downhole transmission sequence by instruction from the surface. In either case, the interruption in drilling is minimal and resultant data output is greatly improved.

The use of several magnetic sensors allows dynamic orientation monitoring for distances up to 30 feet or more from the casing. In most sidetrack or re-entry conditions, the profile of the new wellbore will allow orientation control from the conventional gravity sensors, which are incorporated into the tool design, before the magnetic sensors are too far away from the magnets or the whipstock. However, the system can be configured to space the magnetic sensors over a greater distance and allow dynamic-referenced positioning control for longer distances from the casing if required. As drilling progresses, the magnetic dip angle and the total magnetic field measurements are monitored for indications that the tri-axial sensors are clear of magnetic interference from the original well's casing and that directional measurements are reliable.

The invention has significant advantages. The system allows orientation in the vicinity of the casing without the need for gyros. Continuous measurement can be made during drilling of the first 30 feet or so of the sidetracked wellbore. Drilling can be at a faster rate as reactive torque can be continuously monitored and corrected for.

While the invention has been shown or described in only some of its forms, it should be apparent to those skilled in the art that it is not so limited, but is susceptible to various changes without departing from the scope of the invention.

I claim:

1. An apparatus for drilling an initial portion of a sidetracked wellbore from a well having a sidetrack opening in a casing, comprising:

a whipstock adapted to be landed in the casing and having an inclined surface and at least one magnet positioned on the inclined surface, the whipstock adapted to be oriented to place the inclined surface facing in a desired direction;

a drill string adapted to be lowered into the casing and into engagement with the inclined surface;

a drill bit assembly on a lower end of the drill string for drilling the sidetracked wellbore through the opening; and an instrument carried in the drill string having a magnetic sensor for detecting the magnet, the sensor having a preset alignment with the drill bit assembly, the sensor being shielded so that it will detect the magnet only when the instrument is rotated into general alignment with the magnet, the instrument providing a signal to the surface regarding orientation of the sensor relative to the magnet to enable steering of the drill bit assembly during drilling.

2. The apparatus of claim 1 wherein the whipstock is adapted to be lowered into the casing with the drill string and is adapted to remain landed in the casing while the drill string is retrieved and rerun with the drill bit assembly.

3. The apparatus of claim 1, further comprising a triaxial magnetic and gravity sensor and an instrument microprocessor in the instrument for providing directional information to the surface after the sidetracked wellbore has proceeded a sufficient distance from the casing so as to avoid being influenced by the casing.

4. The apparatus of claim 1, further comprising a pulser mounted to the instrument for creating pulses in drilling fluid in the well to transmit the signals to the surface.

5. The apparatus of claim 1 wherein the magnet is located along a centerline of the inclined surface.

6. The apparatus of claim 1 wherein said at least one magnet comprises a plurality of longitudinally spaced-apart magnets which are embedded in the inclined surface.

7. The apparatus of claim 1 wherein the magnet is embedded in the inclined surface.

8. The apparatus of claim 1 wherein the instrument is adapted to be lowered into and retrieved through the drill string.

9. The apparatus of claim 1 wherein the instrument is located in a nonmagnetic housing in part of the drill string.

10. An apparatus for guiding a drill bit assembly on a drill string while drilling an initial portion of a sidetracked wellbore from a well having a casing with a sidetrack opening therein, comprising:

a whipstock adapted to be lowered into the casing on the drill string and set in the casing in a desired fixed orientation while the drill string is retrieved and returned with the drill bit assembly, the whipstock having an inclined surface and a plurality of magnets embedded along a centerline of the inclined surface; and an instrument adapted to be located within the drill string, the instrument having a plurality of magnetic sensors that are shielded for detecting the magnets only when the drill string and the instrument are rotated into a general alignment with the magnets, and the instrument adapted to provide a signal to the surface regarding alignment of the sensors relative to the magnets, the sensors having a preset fixed alignment with the drill bit assembly to enable steering of the bit assembly during drilling.

11. The apparatus of claim 10, further comprising a triaxial magnetic and gravity sensor and an instrument microprocessor in the instrument for providing directional information to the surface after the sidetracked wellbore has proceeded a sufficient distance from the casing so as to avoid being influenced by the casing.

12. The apparatus of claim 10, further comprising a pulser mounted to the instrument for creating pulses in drilling fluid in the well to transmit the signals to the surface.

13. The apparatus of claim 10 wherein the instrument is adapted to be lowered into and retrieved through the drill string.

14. The apparatus of claim 10 wherein the instrument is located in a nonmagnetic housing in part of the drill string.

15. A method for initiating a sidetracked wellbore from a well having a casing, comprising:

(a) lowering a downhole assembly in the casing, the downhole assembly including a whipstock having an inclined surface and a magnet for creating a magnetic field;

(b) lowering a gyro instrument into the downhole assembly, orienting the inclined surface in a desired direction independently of the magnetic field of the magnet with the use of the gyro instrument, then setting the inclined surface in the desired direction and removing the gyro instrument;

(c) forming a sidetrack opening in the casing;

(d) lowering a drill string into the casing and engaging the inclined surface, the drill string having a steerable drill bit assembly on a lower end of the drill string, the drill string carrying a directional instrument having a magnetic sensor that has a preset fixed alignment with the drill bit assembly and is shielded so as to detect the magnetic field of the magnet only when the magnetic sensor is rotationally oriented into general alignment with the magnet; then (e) providing signals to the surface from the magnetic sensor and rotating the directional instrument until the signals indicate that the magnetic sensor is generally aligned with the magnet, thus determining a drilling direction of the drill bit assembly; then (f) rotating the drill bit assembly and drilling a sidetracked wellbore through the sidetrack opening.

16. The method according to claim 15, wherein step (a) comprises positioning the magnet on the inclined surface.

17. The method according to claim 15, wherein in step (a), the downhole assembly is lowered on the drill string, and after the gyro instrument is removed in step (b), the drill string is retrieved, leaving the downhole assembly set in the casing, and then the drill string is rerun with the drill bit assembly and the magnetic sensor.

18. The method of claim 15, further comprising the step of providing directional information to the surface after the sidetracked wellbore has proceeded a sufficient distance from the opening in the casing so as to avoid being influenced by the casing, the directional information being provided by a triaxial sensor and an instrument microprocessor incorporated in the directional instrument.

19. The method of claim 15 wherein step (e) comprises sending signals to the surface through drilling fluid in the wellbore and in the casing with a pulser.

20. The method of claim 15 wherein in step (d), the directional instrument is lowered into the drill string after the drill string has been lowered into the casing.

21. The method of claim 15 wherein step (c) is performed after step (b) by milling a window in the casing with the drill string.

* * * * *